US005669163A

United States Patent [19]

Winter

[11] Patent Number: 5,669,163

[45] Date of Patent: Sep. 23, 1997

[54] SNOW REMOVAL DEVICE

[76] Inventor: Clem Winter, 2546 Lake Ridge Ct., Wichita, Kans. 67205

[21] Appl. No.: 625,720

[22] Filed: Mar. 29, 1996

[51] Int. Cl.[6] ..... E01H 5/02

[52] U.S. Cl. ..... 37/284; 37/265; 37/281

[58] Field of Search ..... 37/264, 265, 278, 37/284, 285, 273; 172/354, 358, 365; 294/54.4, 57

[56] References Cited

U.S. PATENT DOCUMENTS

| | | | |
|---|---|---|---|
| D. 190,820 | 7/1961 | O'Connor | 37/284 X |
| 1,534,179 | 4/1925 | Klinger . | |
| 1,743,161 | 1/1930 | Prindle | 37/284 |
| 1,956,295 | 4/1934 | Lindgren . | |
| 2,060,717 | 11/1936 | Bates . | |
| 2,114,641 | 4/1938 | Stevenson | 37/284 |
| 2,165,314 | 7/1939 | Stevenson | 37/284 |
| 2,256,953 | 9/1941 | Smith . | |
| 2,336,553 | 12/1943 | Leunis . | |
| 2,508,612 | 5/1950 | Kimbler . | |
| 2,513,230 | 6/1950 | Bourne et al. . | |
| 2,715,786 | 8/1955 | Dorko . | |
| 2,803,071 | 8/1957 | Pochopien . | |
| 2,811,792 | 11/1957 | Cork, Jr. . | |
| 2,863,232 | 12/1958 | Steinbach et al. . | |
| 3,350,797 | 11/1967 | Dassinger et al. . | |
| 3,429,060 | 2/1969 | Merry . | |
| 3,475,838 | 11/1969 | Hagen et al. . | |
| 3,998,486 | 12/1976 | Mittelstadt . | |
| 4,166,330 | 9/1979 | Flick . | |
| 4,179,828 | 12/1979 | Brunty . | |
| 4,199,181 | 4/1980 | Mason | 37/284 |
| 4,302,894 | 12/1981 | Emma . | |
| 4,512,091 | 4/1985 | Leininger et al. . | |
| 4,858,348 | 8/1989 | Lundy . | |
| 4,910,893 | 3/1990 | Asay . | |
| 5,048,206 | 9/1991 | Jones . | |
| 5,056,245 | 10/1991 | Jenkins et al. . | |

*Primary Examiner*—Terry Lee Melius
*Assistant Examiner*—Robert Pezzuto
*Attorney, Agent, or Firm*—Chase & Yakimo

[57] ABSTRACT

A snow removal device including a blade having an increasing radius of curvature between the lateral ends of the blade. A planar lower edge contacts the underlying surface and increases in contact area between the blade ends. The snow blade further has a forwardly extending flange at one end thereof so as to bear against a vertical surface adjacent a path such as a curb, building, wall or the like. The blade design forwardly and laterally moves successively increasing amounts of snow during a straight line movement of the blade along the path as well as diverts snow from the vertical surface. The blade is engageable with various handle devices, including a mobile push-type assembly. The assembly includes a handle and blade brace mounted about a wheel axle. A latch maintains the handle in an operative position during use.

2 Claims, 5 Drawing Sheets

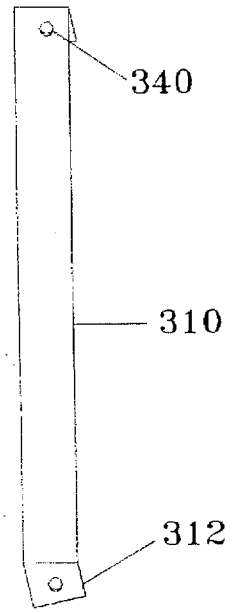
FIG. 5
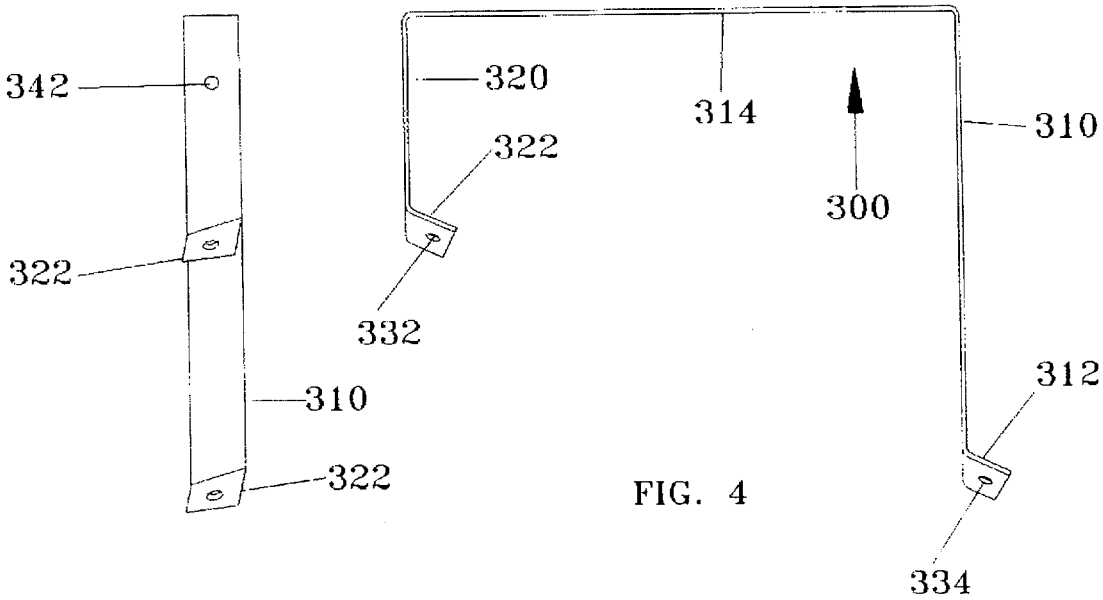
FIG. 4
FIG. 6

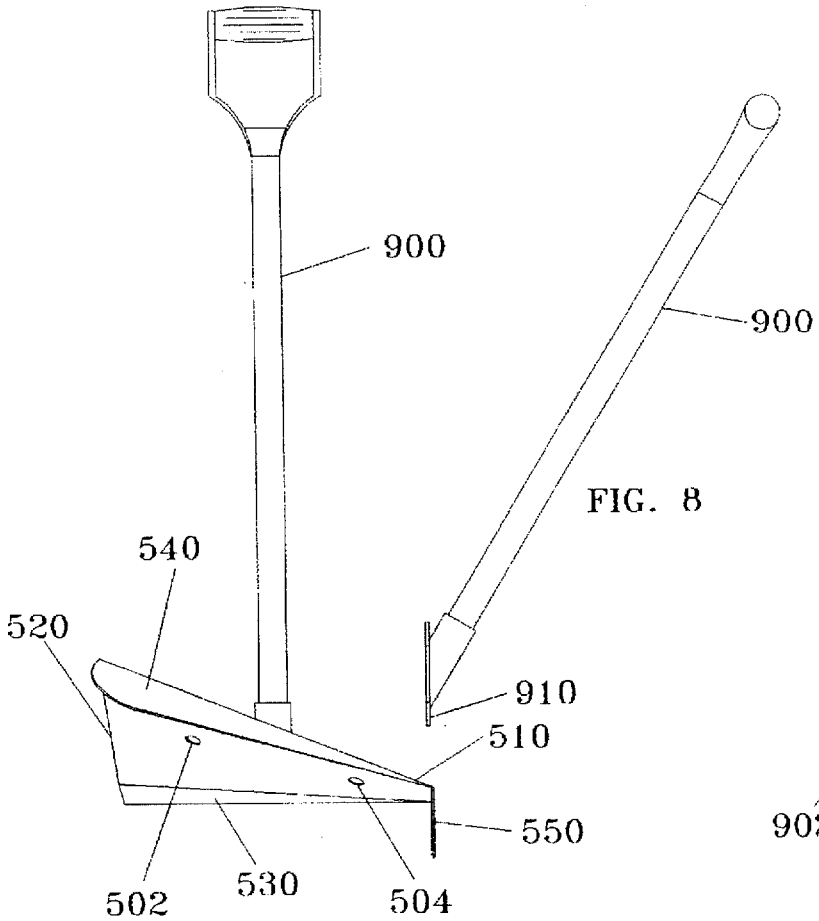
FIG. 8
FIG. 7
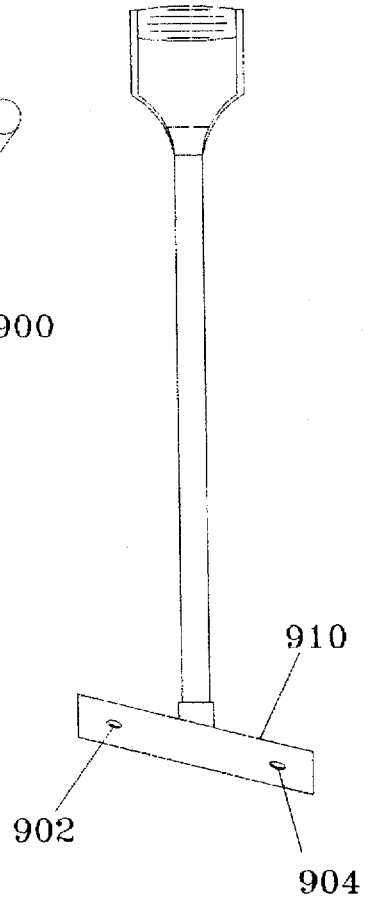
FIG. 9

SNOW REMOVAL DEVICE

BACKGROUND OF THE INVENTION

This invention relates to a snow removal device and, more particularly, to a snow blade adapted to direct snow forwardly and laterally relative to the blade's path of travel, the blade having a guide at one end thereof for directing the blade end along a wall, curb or other vertical surface.

Various snow removal devices are known to facilitate removal of snow from sidewalks, streets and other surfaces. Such blades usually direct the snow along the path of blade travel. In some instances the blade has an accompanying mechanism which will cant the blade relative to a straight line path so as to laterally divert the snow relative to the direction of blade travel. It is thus desirable to present a blade design for laterally and forwardly directing snow along a straight line path. It is also desirable to be able to direct a blade end along a vertical surface adjacent a building, curb or other vertical surface so as to enhance the removal of snow adjacent thereto.

In response thereto I have invented a snow blade having a generally curved configuration increasing in radius from one blade end to the other. In this configuration the blade face angularly and forwardly contacts the snow as the blade is directed along the path of travel. The curved configuration of the blade face laterally and forwardly directs increasing amounts of snow between the blade ends during the straight line travel of the blade. Accordingly, the snow is directed forwardly and to the side of the path of travel, such as a sidewalk, without the need to angularly adjust the blade. A flange forwardly extends from one end of the blade so as to guide the blade along walls, curbs, and other vertical edges. The blade can be mounted to various handles including a mobile handle assembly. The assembly with blade therein is equipped with a latch mechanism rendering the device collapsible for easy storage.

Accordingly, it is an object of this invention to provide an efficient snow removal device.

Another object of this invention is to provide a device, as aforesaid, which directs successively larger amounts of snow forwardly as well as towards the side of the path of travel of the blade.

A further object of this invention is to provide a device, as aforesaid, the blade having a guide at one end thereof for directing the blade end along a wall, curb, or other vertical surface.

Another object of this invention is to provide a device, as aforesaid, the blade being adaptable for use with various handles, snow plows, and mobile assemblies.

A further object of this invention is to provide a device, as aforesaid, the blade being associated with a latching mechanism providing for a collapsible assembly.

Other objects and advantages of this invention will become apparent from the following description taken in connection with the accompanying drawings, wherein is set forth by way of illustration and example, an embodiment of this invention.

BRIEF DESCRIPTION OF THE DRAWINGS

FIG. 4 is a top view showing a brace for attachment of the blade to the assembly of FIG. 1 or other handle;

FIG. 5 is a right side view of the brace of FIG. 4;

FIG. 6 is a left side view of the brace of FIG. 4;

FIG. 7 is a view showing the blade attached to a shovel handle;

FIG. 8 is a side view of the handle as removed from the blade;

FIG. 9 is a perspective view of the handle as removed from the blade;

DESCRIPTION OF THE PREFERRED EMBODIMENT

Figure 1:
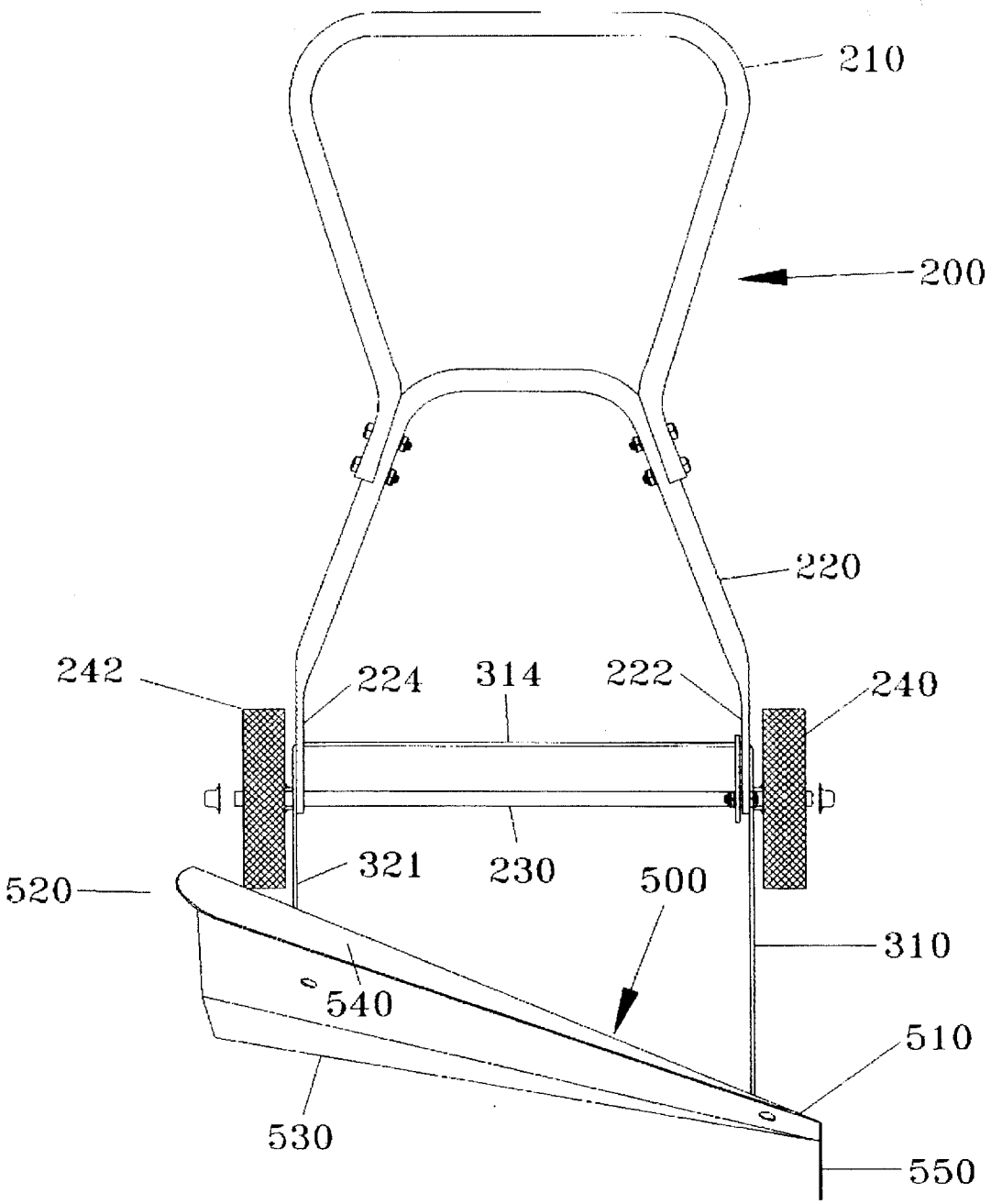
FIG. 1 is a top view of the snow removal device.

Turning more particularly to the drawings, FIG. 1 illustrates one form of the snow removal device 100 as comprising a mobile push handle assembly 200 with blade 500 attached thereto. Blade 500 may be utilized with various types of handle assemblies. As such, the blade 500 comprises a generally rigid sheet of metal or other suitable rigid material, presenting left and right lateral ends 510, 520 (as viewed by a user behind the blade 500) and lower 530 and upper 540 edges. The blade 500 generally increases in its radius of curvature upon blade extension between the left 510 lateral end and the right lateral end 520. Blade 500 generally presents a generally planar lower edge 530 and upper 540. As shown in FIG. 1, at least edge 530 has a generally planar surface which increases in dimension between the left 510 and right 520 ends. Also, the displacement between the lower 530 and upper 540 edges will also successively increase between the lateral left end 510 and right end 520.

The planar portion of the front edge 530 of the snow blade 500 contacts the underlying surface. Extending from the left end 510 of the blade 500 is a forwardly extending flange 550 which acts as a guide for bearing against vertical surfaces such as walls, curbs and the like.

The blade can be attached to a flange 910 of handle 900 as shown in FIGS. 5–7 by means of a bolt/nut combination extending through apertures 902, 904, 502, 504 in the flange 910 and blade 500.

Figure 2:
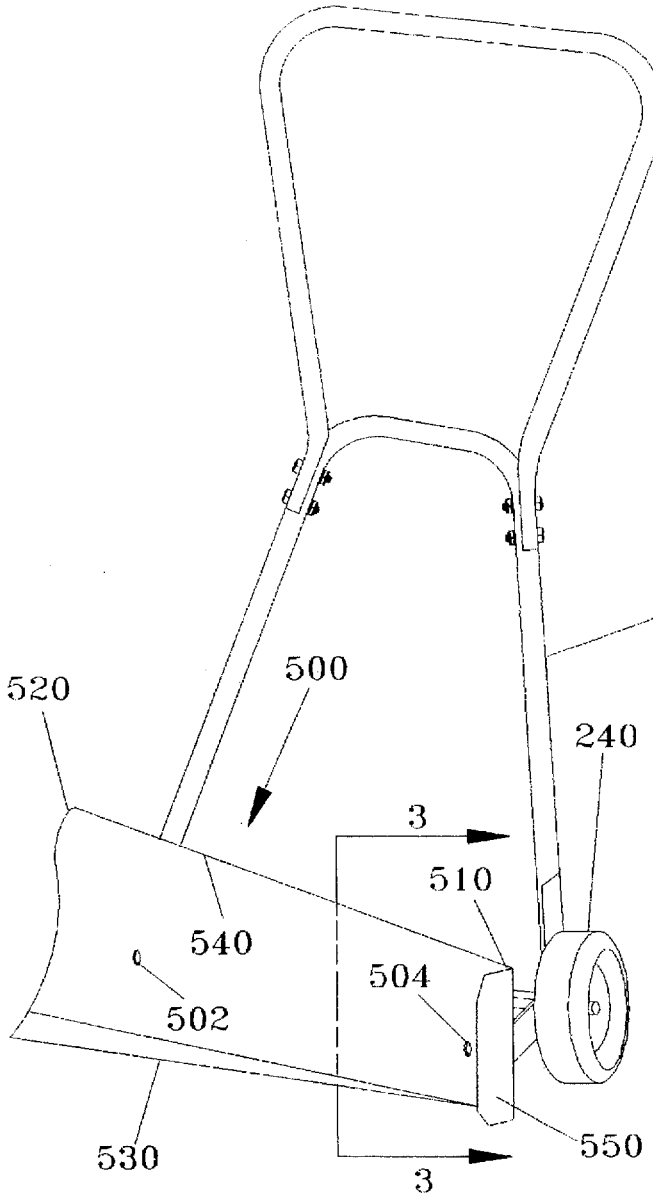
FIG. 2 is a perspective view of the device of FIG. 1.
Figure 3:
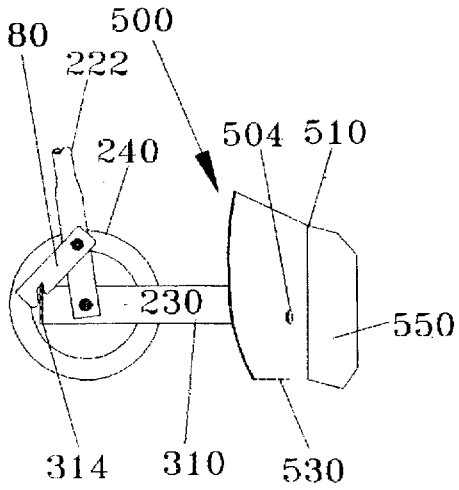
FIG. 3 is a section view of a portion of the device of FIG. 2 taken along lines 3—3 in FIG. 2.
Figures 10, 11:
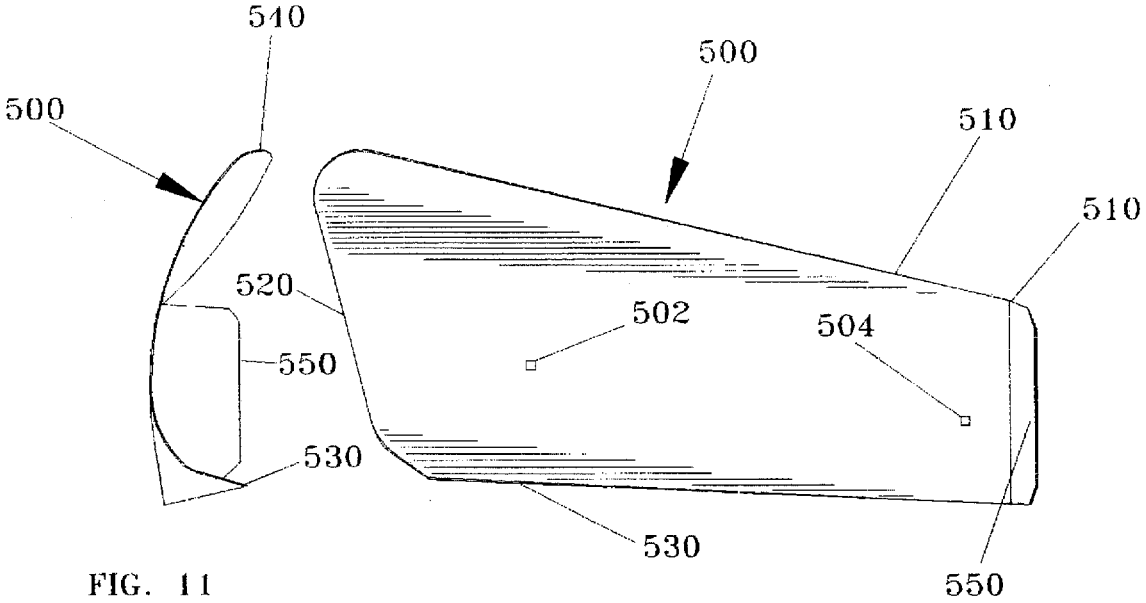
FIG. 10 is a front view of the blade.
FIG. 11 is a side view of the blade of FIG. 10.
Figure 1:
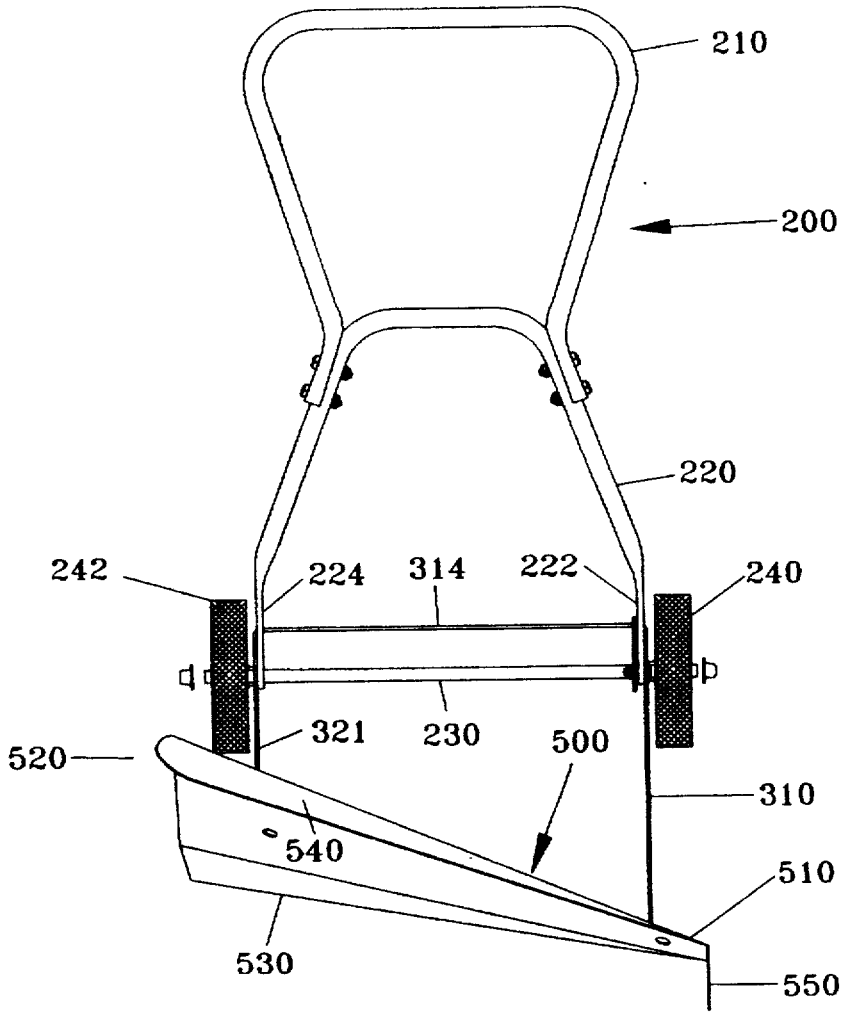
Figure 2:
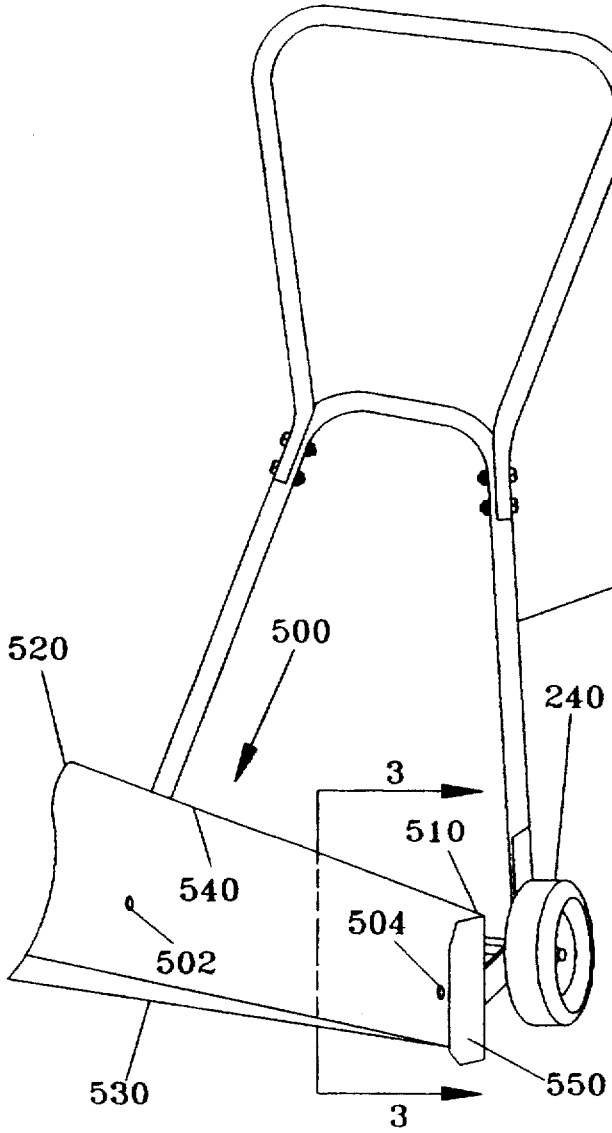
Figure 3:
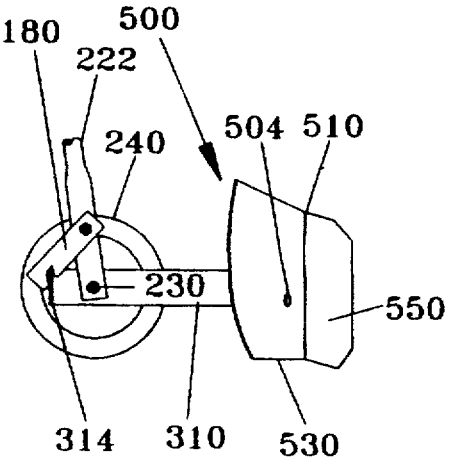
Figures 10, 11:
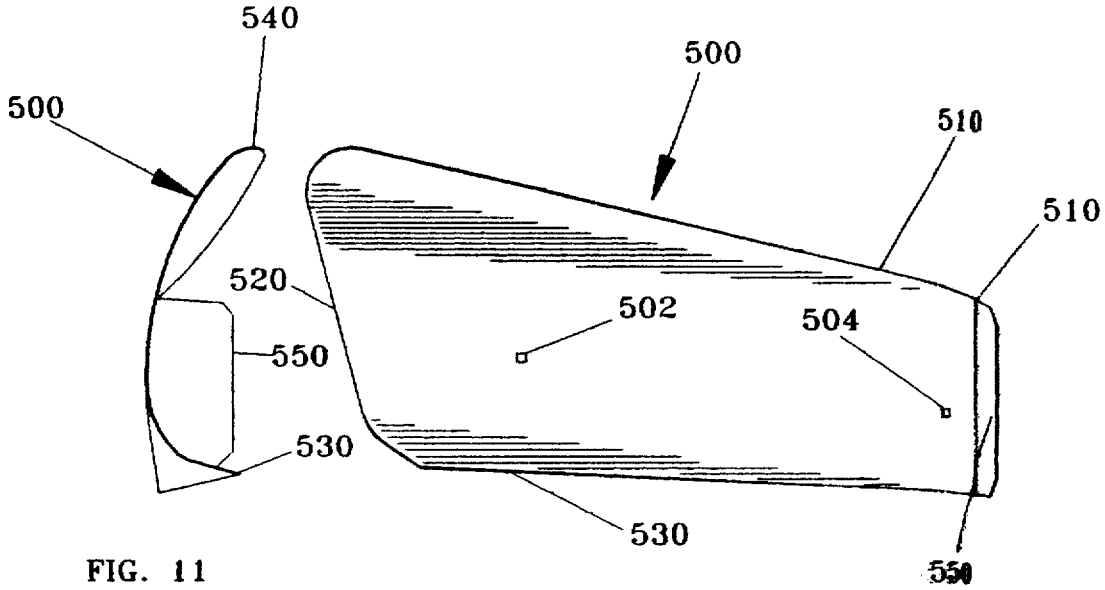

A mobile push assembly 200 is as shown in FIGS. 1–3. This assembly 200 generally comprises an upper handle 210 attached to a lower handle 220, the lower handle 220 having laterally spaced-apart arms 222, 224 pivotally attached about axle 230, the axle 230 having wheels 240, 250 thereon. Further attached to the axle is a brace 300, the brace 300 having a first arm 310 and a second relatively shorter arm 320 with cross arm 314 extending therebetween. The end of each arm 310, 320 present mounting flanges 312, 322 with apertures 332, 334 therein, the flanges attached to the blade 500 by bolt/nut combinations extending through these apertures and apertures 502, 504 in the blade 500 face. The axle 230 extends through apertures 340, 342 in the brace arms 310, 320, these arms being rotatable about the axle 230. This structure allows the forward edge 530 of the blade 500 to float along the underlying surface during forward blade movement.

Further pivotally attached to a bottom of the arm 222 of the lower handle 220 is a latch 180 having a notch at one end thereof. The notch engages the horizontal cross arm 314 of the brace 330 when the device is in an operative position (FIG. 3). At this position, as shown in FIG. 3, the engagement of the notch of the latch 180 with the cross arm 314 of the brace 330 precludes the lower handle 220 from rotating in a counterclockwise position. Thus, the lower and upper handles are held in position for functional use. For storage, the latch 180 is rotated away from cross arm 314. This position allows the handles to rotate beyond their functional use position to allow the device to be hung from a wall or the like.

In use, upon pushing the snow blade 500 along a straight line path, the left end 510 of the blade 500 will initially contact the underlying snow. Due to the increase in blade curvature radius between the smaller left end 510 and larger right end 520, increasingly larger amounts of snow will be successively pushed forward and concurrently laterally diverted relative to the straight line path. Accordingly, this blade 500 configuration precludes the entire face of blade from contacting equal amount of snow in a head-on or flush position. The direction of successively increasing amounts of snow forwardly and laterally relative to the straight line path, effectively enhances snow removal by the user as the user need not make two separate directional sweeps of the path to forwardly and laterally direct equal amounts of snow. Also, as the blade is not directly fronting equal amounts of snow, blade travel is enhanced along the straight line path.

Also, during use the flange 550 at the left end 510 of the blade 500 can guide the blade end 510 along vertical surfaces. Accordingly, this guide 550 aids the user in pushing the snow blade along a straight line path, e.g. along a building, curb or other surface. Moreover, the guide 550 assures displacement of the snow adjacent such surfaces.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A snow removal device comprising:

a mobile handle assembly comprising:

an axle;

a wheel rotatably mounted at each end of said axle;

a brace having first and second arms with a cross arm spanning therebetween, said axle extending between said brace arms for mounting said brace rotatably about the axle; and a handle rotatably attached to said axle, said handle having first and second arms with said axle extending therethrough for rotatably mounting said handle about said axle;

a latch attached to one of said handle arms;

a notch in said latch for engaging said cross arm to restrain rotation of said handle about said axle;

a snow blade comprising:

a relatively rigid sheet of material presenting a front face for contact with snow during a movement of said blade along a straight line path of travel;

said sheet having first and second laterally spaced-apart opposed ends;

said sheet having a radius of curvature generally increasing from said first end to said second end, said curvature presenting upper and lower edges on said sheet which generally increase in displacement between said first and second ends, said sheet further comprising a lower surface on said sheet generally extending horizontally and forwardly from said lower edge thereof for contact with an underlying surface, said lower surface increasing in area between said first end and said second end of said sheet, whereupon said blade upon straight line movement contacts successively larger portions of snow between said first and second ends during the straight line movement;

means for attaching said snow blade to said ends of said arms of said brace.

2. The device as claimed in claim 1 further comprising a flange normally extending from one of said blade ends, said flange bearing against a vertical surface adjacent the straight line path for diverting snow from the vertical surface.

* * * * *

UNITED STATES PATENT AND TRADEMARK OFFICE

CERTIFICATE OF CORRECTION

PATENT NO. : 5,669,163
DATED : Sept. 23, 1997
INVENTOR(S) : Clem Winter

It is certified that error appears in the above-identified patent and that said Letters Patent is hereby corrected as shown below:

The title page should be deleted to appear as per attached title page.

Please delete drawing sheets 1-5 and substitute drawing sheets 1-5 as per attached.

Signed and Sealed this

Eighteenth Day of November 1997

*Attest:*

Bruce Lehman

BRUCE LEHMAN

*Attesting Officer*

*Commissioner of Patents and Trademarks*

US005669163A

United States Patent [19]

Winter

[11] Patent Number: 5,669,163

[45] Date of Patent: Sep. 23, 1997

[54] SNOW REMOVAL DEVICE

[76] Inventor: Clem Winter, 2546 Lake Ridge Ct., Wichita, Kans. 67205

[21] Appl. No.: 625,720

[22] Filed: Mar. 29, 1996

[51] Int. Cl.[6] ..... E01H 5/02

[52] U.S. Cl. ..... 37/284; 37/265; 37/281

[58] Field of Search ..... 37/264, 265, 278, 37/284, 285, 273; 172/354, 358, 365; 294/54.4, 57

[56] References Cited

U.S. PATENT DOCUMENTS

| | | | |
|---|---|---|---|
| D. 190,820 | 7/1961 | O'Connor | 37/284 X |
| 1,534,179 | 4/1925 | Klinger . | |
| 1,743,161 | 1/1930 | Prindle | 37/284 |
| 1,956,295 | 4/1934 | Lindgren . | |
| 2,060,717 | 11/1936 | Bates . | |
| 2,114,641 | 4/1938 | Stevenson | 37/284 |
| 2,165,314 | 7/1939 | Stevenson | 37/284 |
| 2,256,953 | 9/1941 | Smith . | |
| 2,336,553 | 12/1943 | Leunis . | |
| 2,508,612 | 5/1950 | Kimbler . | |
| 2,513,230 | 6/1950 | Bourne et al. . | |
| 2,715,786 | 8/1955 | Dorko . | |
| 2,803,071 | 8/1957 | Pochopien . | |
| 2,811,792 | 11/1957 | Cork, Jr. . | |
| 2,863,232 | 12/1958 | Steinbach et al. . | |
| 3,350,797 | 11/1967 | Dassinger et al. . | |
| 3,429,060 | 2/1969 | Merry . | |
| 3,475,838 | 11/1969 | Hagen et al. . | |
| 3,998,486 | 12/1976 | Mittelstadt . | |
| 4,166,330 | 9/1979 | Flick . | |
| 4,179,828 | 12/1979 | Brunty . | |
| 4,199,181 | 4/1980 | Mason | 37/284 |
| 4,302,894 | 12/1981 | Emma . | |
| 4,512,091 | 4/1985 | Leininger et al. . | |
| 4,858,348 | 8/1989 | Lundy . | |
| 4,910,893 | 3/1990 | Asay . | |
| 5,048,206 | 9/1991 | Jones . | |
| 5,056,245 | 10/1991 | Jenkins et al. . | |

*Primary Examiner*—Terry Lee Melius
*Assistant Examiner*—Robert Pezzuto
*Attorney, Agent, or Firm*—Chase & Yakimo

[57] ABSTRACT

A snow removal device including a blade having an increasing radius of curvature between the lateral ends of the blade. A planar lower edge contacts the underlying surface and increases in contact area between the blade ends. The snow blade further has a forwardly extending flange at one end thereof so as to bear against a vertical surface adjacent a path such as a curb, building, wall or the like. The blade design forwardly and laterally moves successively increasing amounts of snow during a straight line movement of the blade along the path as well as diverts snow from the vertical surface. The blade is engageable with various handle devices, including a mobile push-type assembly. The assembly includes a handle and blade brace mounted about a wheel axle. A latch maintains the handle in an operative position during use.

2 Claims, 5 Drawing Sheets

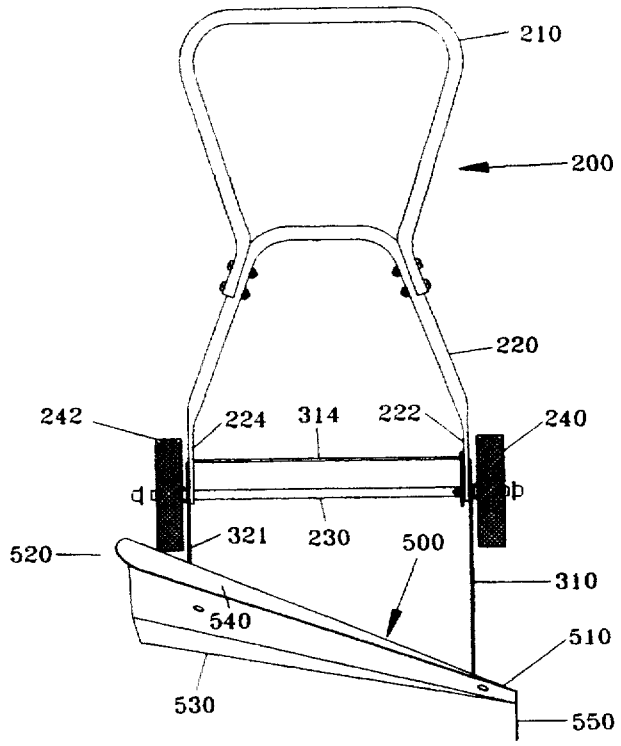

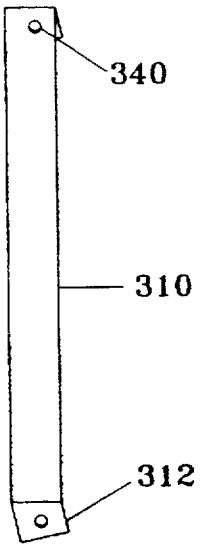
FIG. 5
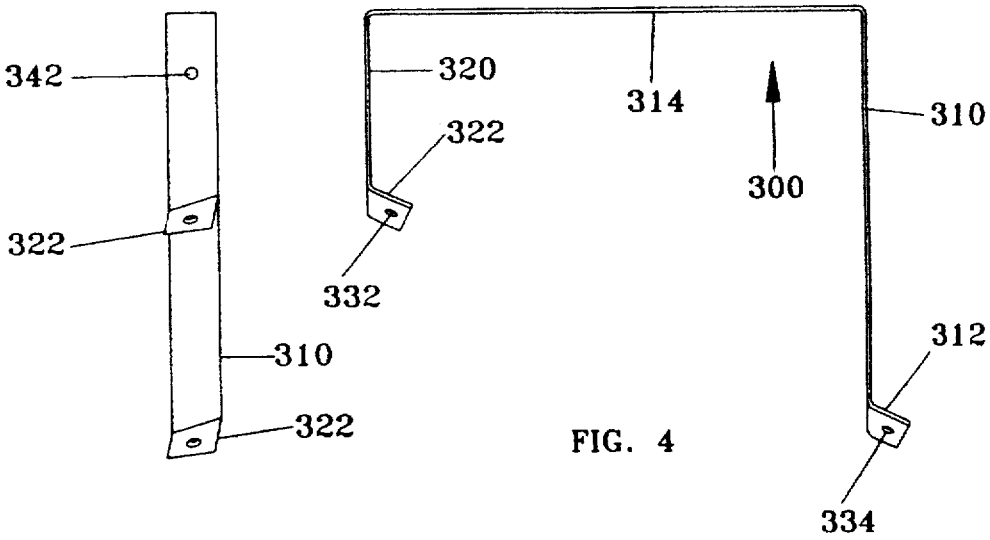
FIG. 4
FIG. 6

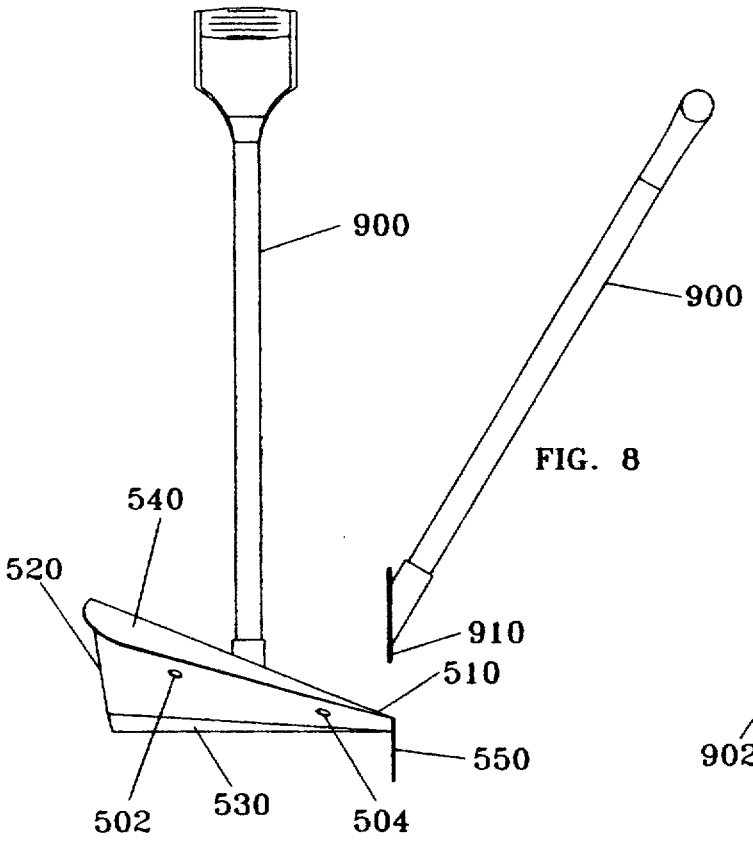
FIG. 8
FIG. 7
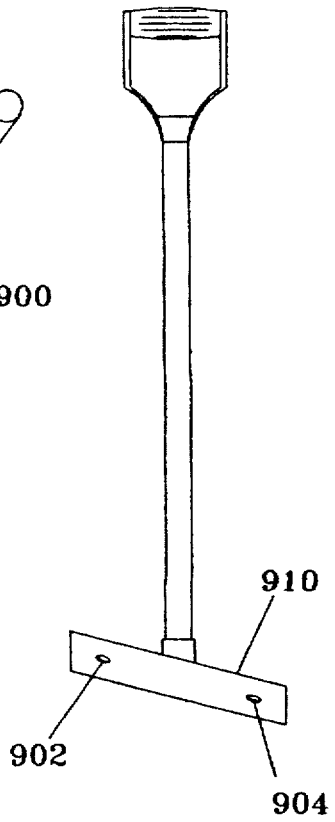
FIG. 9